United States Patent [19]

Thomson

[11] 3,931,656

[45] Jan. 13, 1976

[54] SURFBOARD LEASH

[76] Inventor: Derek Vincent Thomson, Escalls Cliff, Sennen, Cornwall, England

[22] Filed: June 13, 1974

[21] Appl. No.: 479,062

[52] U.S. Cl. ..... 9/310 E; 9/310 AA; 267/69

[51] Int. Cl.[2] ..... A63C 15/06

[58] Field of Search ..... 9/310 A, 310 AA, 310 E, 9/310 R, 311, 314; 115/6.1; 24/DIG. 4, DIG. 2, 129 D, 73 A; 267/69

[56] References Cited

UNITED STATES PATENTS

| | | | |
|---|---|---|---|
| 2,117,322 | 5/1938 | Hillman | 267/69 |
| 3,802,011 | 4/1974 | Castagnola | 9/310 E |

*Primary Examiner*—Trygve M. Blix
*Assistant Examiner*—Sherman D. Basinger
*Attorney, Agent, or Firm*—Sughrue, Rothwell Mion Zinn & Macpeak

[57] ABSTRACT

A surfboard leash for attaching a surfboard to a surfer, having a tubular outer element made of a resilient material such as rubber, and a partially resilient inner reinforcement element made from a material having a limited stretching ability, such as braided nylon cord. The natural length of the inner reinforcement element is several times the natural length of the outer casing, so that when unextended it lies coiled within it, but the maximum stretched length of the inner reinforcement element is less than the maximum stretched length of the outer tubular casing so that the outer casing is protected from breakage.

11 Claims, 3 Drawing Figures

SURFBOARD LEASH

BACKGROUND OF THE INVENTION

The present invention relates to a surfboard leash of resilient material for linking a surfer and his surfboard, particularly to use with the floating type of surfboard known as a "Malibu" board. Surfing on this type of board is performed with the surfer standing on the board which has sufficient buoyancy to support the surfer entirely out of the water. Leashes of this general type are known but have not found wide acceptance due to the fact that a satisfactory design had not been found until the present invention was made.

Even when surfing on relatively small waves the distance from the beach to the "take-off" point where the surf riding starts is often quite large and on large waves the distance to the take-off point can be very considerable. After each surf ride a surfer has to swim, with his surfboard from the beach to the take-off point and this clearly represents the major part of the physical effort involved and is quite time consuming. Since it is a difficult operation to get the surfboard moving down the slope of a wave and then to stand up on it, involving great balancing skill, it frequently happens that the intending surfer loses his balance and falls off his surfboard before actually getting properly under way. This is known as a "wipe out." If this happens the surfer is separated from his surfboard, which later is carried by the wave back to the beach. The surfer, however, is left to swim back to the beach to retrieve his board and then has to return with it to the take-off point in order to try again. This obviously increases the amount of time wasted in swimming, without the surfer even having a surf-ride. Apart from this disadvantage to the surfer, there is a further disadvantage, from the point of view of other surfers or swimmers, since the surfboard carried alone by a wave represents a safety hazard. Being unguided and, normally, broadside on to the wave, it is both difficult to spot and difficult to avoid. An impact between a swimmer and such a free surfboard can be quite dangerous since there is the possibility that the swimmer may be knocked unconscious, in addition to any damage which may be caused by the impact.

If each surfer were to have his surfboard attached to him then upon the occurence of a "wipe-out" he would nevertheless be able to retrieve the board without having to return from the take-off point to the beach. Moreover, the danger from freely moving unguided surfboards would be correspondingly reduced since, being attached to a surfer, they would have only a limited range of free movement.

The achievement of this ideal situation has been hindered, however, by the fact that leashes must have particular characteristics for their safe and consistent use by surfers. For example, it is not possible to use an inelastic leash tied to any part of the body of the surfer, since the shock imparted when all the slack has been taken up upon separation of the surfboard and the surfer would be likely to cause injury to the surfer, and may possibly damage the surfboard. In order to overcome this difficulty resilient leashes have been tried in order that the resilience will progressively absorb the shock as the leash becomes extended. Previously used resilient leashes, however, have suffered from two major disadvantages; first, if the resilience allows the leash to stretch considerably there is a risk either of breakage of the leash when fully stretched or of collision between the surfer and the surfboard as it returns upon contraction of the leash following full extension; secondly, if the resilience of the leash is such that only a small extension is possible, the previously mentioned disadvantage of inelastic leashes is not fully overcome and there is a possibility that the force of a powerful wave pulling on the board could be sufficient to dislocate a surfer's ankle, knee or thigh. Moreover, there is a risk that, when the surfer is separated from the surfboard in a large wave, the speed and momentum of the board will cause a hold-down situation with the surfer being dragged under the water.

OBJECTS OF THE INVENTION

The object of the present invention is to provide a resilient surfboard leash which is sufficiently elastic to absorb the force of a large wave carrying a surfboard away from a surfer while nevertheless being adequately reinforced against breakage at full extension.

It is another object of this invention to provide a resilient surfboard leash in which there is a certain measure of damping upon contraction thereof.

It is a further object of this invention to provide a surfboard leash having an elastic outer casing with an inner reinforcement which is itself resilient.

SUMMARY OF THE INVENTION

According to the present invention a surfboard leash comprises an outer tubular casing of resilient material having at least one separate internal reinforcement element attached to the outer casing at each end thereof, the reinforcement element itself being resilient.

Preferably the natural length of the reinforcement element is greater than the natural length of the outer tubular casing.

In the preferred embodiment the maximum extended length of the reinforcement element is shorter than the maximum extended length of the outer tubular casing. The outer tubular casing is preferably made of a material capable of extension to at least eight times its natural length and the resilience of the inner reinforcement element is preferbly such as to allow the element to extend by only a fraction of its natural length, for example between 10 percent and 20 percent thereof.

It has been found that the relative dimensions of the diameter of the inner reinforcement element and the inner diameter of the outer tubular casing, together with the wall thickness of the outer tubular casing and the resilience of the material thereof, with respect to the natural length of each of these elements, has a critical bearing on the performance of the leash. Thus, the natural length of the inner reinforcement element should be greater than one and a half times, and less than seven times, the natural lenth of the outer tubular casing. Similarly, it is preferred that the diameter of the inner reinforcement element should lie between one fifth and one third of the diameter of the bore in the tubular outer casing and the wall thickness of the tubular outer casing lies between one sixth and one quarter of the said bore diameter although tubes having wall thicknesses between one eighth and three quarters of the bore diameter can be used. In an example of a preferred embodiment the outer tubular casing has an inner diameter of 8 mm., a wall thickness of 1.6 mm. and a length of 1 metre; the inner reinforcement element of this example has a diameter between 2 and 3 millimetres and a length of between four and four and a half metres.

The natural length of the inner reinforcement element should not be less than one and a half times the natural length of the outer tubular casing. A suitable material for the outer tubular casing has been found to be latex rubber and a suitable material for the inner reinforcement element is braided nylon cord. The use of braided nylon cord is preferred since this has an appropriate degree of resilience, stretching between 10 percent and 20 percent of its natural length.

The advantages of the present invention are that the extension of the leash as a surfboard is carried away from a surfer smoothly decelerates the board without causing an unacceptable, and possibly dangerous, shock upon reaching full extension. Moreover, if the relative dimensions of the outer tubular casing and the inner reinforcement are within the indicated limits the inner reinforcement is coiled within the outer tubular casing in the unextended condition and the adoption of this coiled position acts to damp the contracting movement of the outer tubular casing thereby avoiding the risk of a dangerous impact as the surfboard returns to the surfer.

Further features and advantages of the present invention will become apparent during the course of the following description with reference to the accompanying drawings which are provided purely by way of non-restrictive example.

DESCRIPTION OF THE PREFERRED EMBODIMENTS

Figure 1:
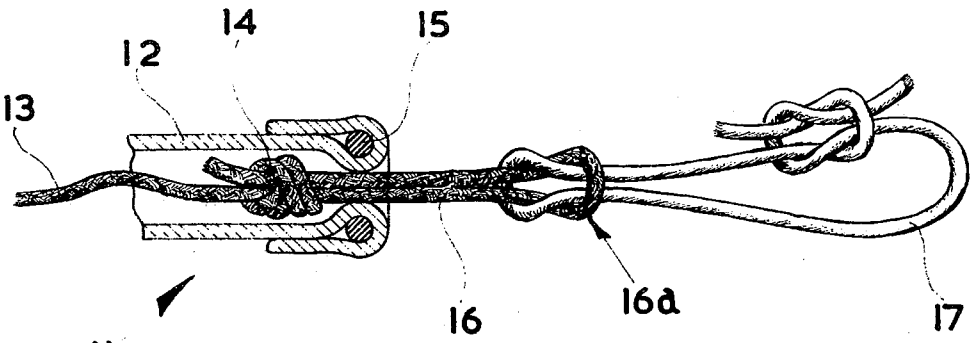
FIG. 1 is a longitudinal cross-section of one end of an embodiment of the invention.
Figure 2:
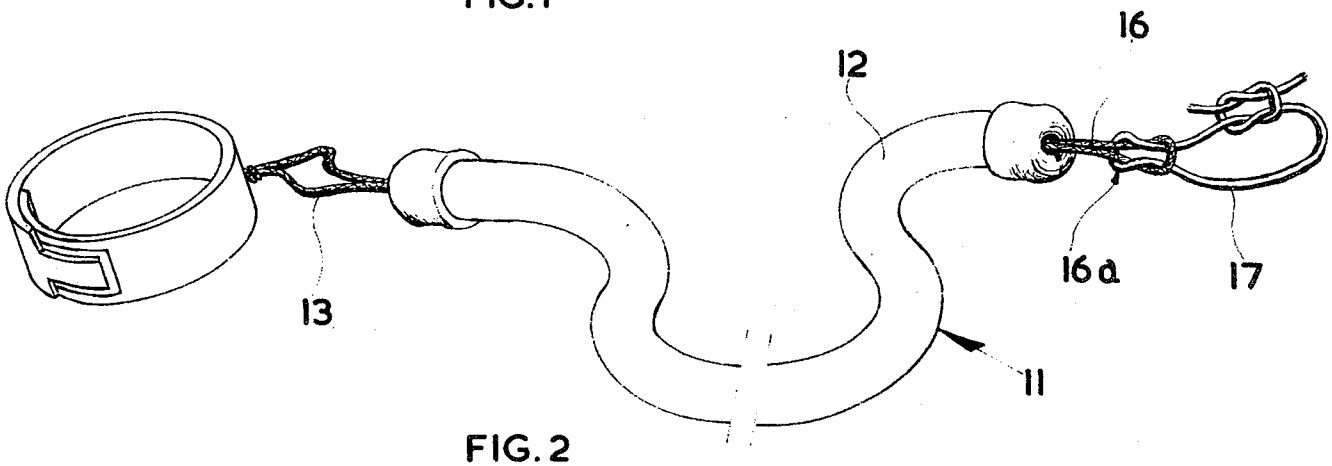
FIG. 2 is a perspective view of a part of the embodiment illustrated in FIG. 1.

Referring now to the drawings there is shown a surfboard leash generally indicated 11 comprising an outer tubular casing 12 of latex rubber having an inner bore diameter of 8 mm., a wall thickness of 1.6 mm. and an unextended length of 1 metre. Within the outer tubular casing 12 there is coiled an inner reinforcement element 13 made of braided nylon cord having a diameter of 2 mm. and an unextended length of 4.3 metres. The cord 13 has a knot 14 adjacent the end of the outer tubular casing 12. On the side of this knot nearest the end of the outer tubular casing 12 there is a compression band 15 which tightly encircles the outer tubular casing 12 compressing this into the inner reinforcement element 13. The compression band 15 in the embodiment illustrated comprises a loop of cord of the same material as the cord 13, although any suitable material resistant to corrosion by seawater could be used. The end of the outer tubular casing 12 is turned back over the band 15 to provide a neat external appearance.

The end of the cord 13 is formed into a loop 16 to which is attached a further loop 17 for attachment of the leash 11 to a fixing ring or other mounting carried on a surfboard. If the auxiliary loop should become chafed or broken it can be replaced readily. This avoids the necessity of replacing the whole leash in the event of chafing and wear.

Figure 3:
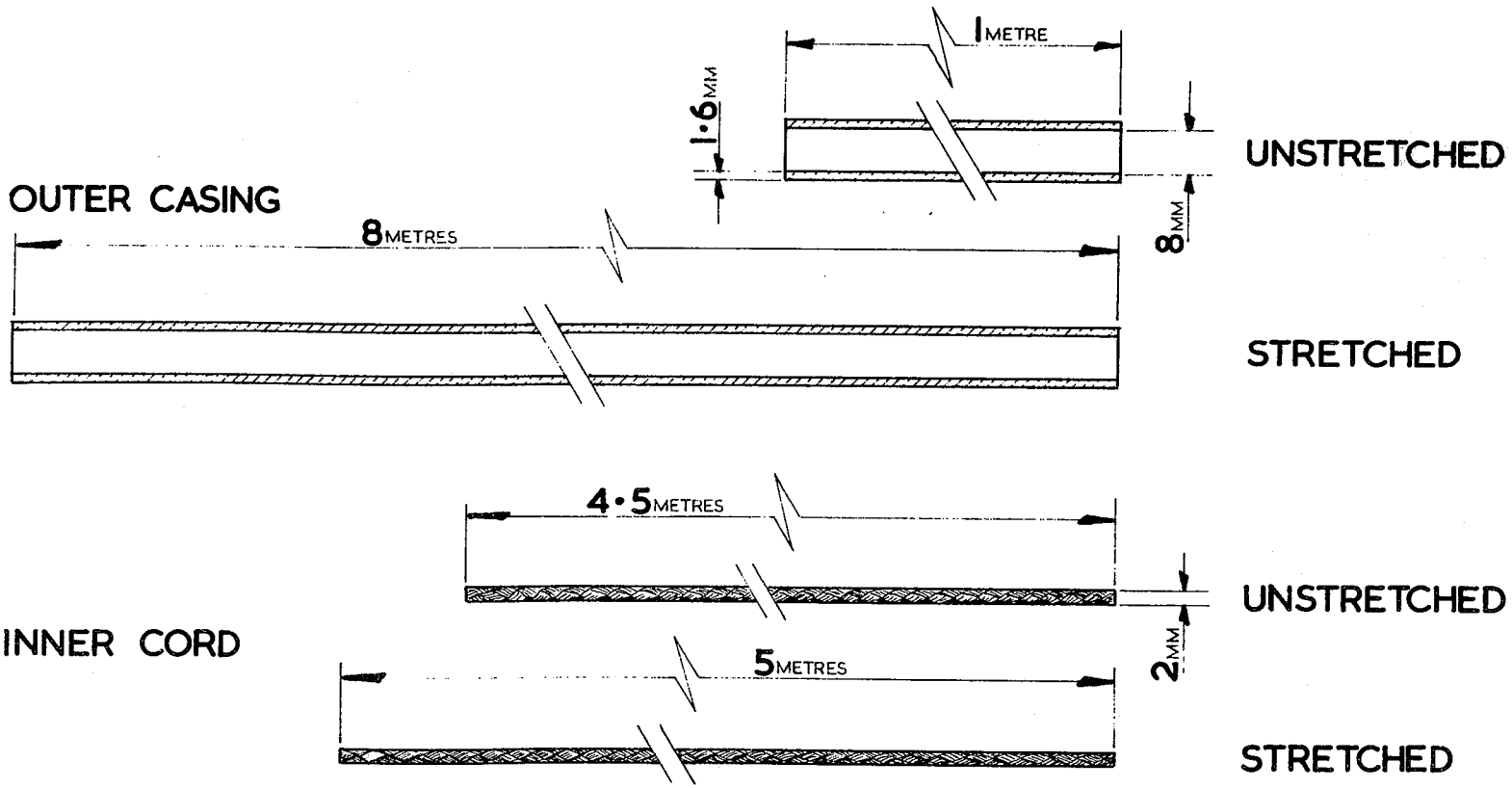
FIG. 3 is a schematic diagram illustrating the relative lengths and diameters of the elements forming the embodiment of FIGS. 1 and 2 in the unextended and the extended positions.

Referring now to FIG. 3 the relative extensions of the inner reinforcement element 13 and the outer tubular casing 12 are shown. It will be seen that the maximum possible extension of the outer tubular casing 12 amount to between 8 and 9 times its unextended length, that is to between 8 and 9 metres. The maximum possible extensions of the inner reinforcement element 13, however, is only to about 5 metres. Thus even when extended to its maximum length the inner reinforcement element 13 prevents the outer tubular casing 12 from stretching to its full extent. The resilience of the outer tubular casing 12 absorbs the shock which would otherwise occur when the slack in the inner reinforcement element is taken up as a surfboard is carried away from a surfer by a wave following a "wipe-out." The friction between the inner reinforcement element 13 and the inner wall of the outer tubular casing 12 also helps to damp the movement, both on expansion and contraction, thereby contributing to the shock absorbing effect. The relative lengths of the two elements is, for this reason, critical to ensure that there is frictional engagement between the elements without binding or deformation which could cause excessive local stretching of the outer tubular casing leading to rapid deterioration and early breakage.

I claim:

1. A leash for attaching a surfboard to a surfer, comprising:

an outer tubular casing of resilient material, at least one separate reinforcement element housed within said outer tubular casing and attached at each end thereto, said reinforcement element itself being resilient, the natural length of said inner reinforcement element being greater than the natural length of said outer tubular casing, and the maximum extended length of said reinforcement element being less than the maximum extended length of said outer tubular casing, first attachment means on one end of said reinforcement element for attaching it to a part of the body of a person, and second attachment means at the other end of said reinforcement element for attaching it to a surfboard.

2. The surfboard leash of claim 1 wherein the natural length of said inner reinforcement element is not less than one and a half times the natural length of said outer tubular casing.

3. The surfboard leash of claim 1, wherein the natural length of said inner reinforcement element is not more than seven times the natural length of said outer tubular casing and the maximum extended length of said outer tubular casing is in the region of eight times its natural length.

4. The surfboard leash of claim 1, wherein the diameter of said inner reinforcement element lies between one fifth and one third of the diameter of the inner bore of said tubular outer casing.

5. The surfboard leash of claim 1, wherein the wall thickness of said tubular outer casing is between one sixth and one quarter the diameter of the bore in said tubular outer casing.

6. The surfboard leash of claim 1, wherein the maximum extended length of said inner reinforcement element is between 10 percent and 20 percent greater than the natural length thereof.

7. The surfboard leash of claim 1, wherein said inner reinforcement element is made of braided nylon cord.

8. The surfboard leash of claim 1 wherein said tubular outer casing is made of a latex rubber.

9. The surfboard leash of claim 1, wherein said inner reinforcement element is knotted at each end and an encircling clamping band secures said tubular outer casing to said inner reinforcement element, said encircling clamping band surrounding said tubular outer casing outwardly of said knots.

10. The surfboard leash of claim 9 wherein said encircling clamping band is made of the same material as said inner reinforcement element and is knotted to hold it in position.

11. The surfboard leash of claim 1, wherein said inner reinforcement element is formed into a loop at one end, said loop projecting from one end of said tubular casing, an auxiliary loop of substantially inextensible material being attached to said loop at said one end of said inner reinforcement element.

* * * * *